US007743855B2

(12) United States Patent
Moss

(10) Patent No.: US 7,743,855 B2
(45) Date of Patent: Jun. 29, 2010

(54) DRILL BIT WITH CUTTER ELEMENT HAVING MULTIFACETED, SLANTED TOP CUTTING SURFACE

(75) Inventor: Brandon Moss, Spring, TX (US)

(73) Assignee: Smith International, Inc., Houston, TX (US)

( * ) Notice: Subject to any disclaimer, the term of this patent is extended or adjusted under 35 U.S.C. 154(b) by 227 days.

(21) Appl. No.: 11/515,678

(22) Filed: Sep. 5, 2006

(65) Prior Publication Data

US 2008/0053710 A1 Mar. 6, 2008

(51) Int. Cl.
*E21B 10/16* (2006.01)
*E21B 10/62* (2006.01)

(52) U.S. Cl. ..... 175/374; 175/412; 175/426

(58) Field of Classification Search ..... 175/412, 175/327, 426, 374
See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,352 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,334,586 | A | 6/1982 | Schumacher |
| 4,352,400 | A | 10/1982 | Grappendorf et al. |
| 4,359,113 | A | 11/1982 | Morris |
| 4,511,006 | A | 4/1985 | Grainger |
| 4,586,574 | A | 5/1986 | Grappendorf |
| 4,604,106 | A | 8/1986 | Hall et al. |
| 4,629,373 | A | 12/1986 | Hall |
| 4,694,918 | A | 9/1987 | Hall |
| 4,716,977 | A | 1/1988 | Huffstutler |
| 4,722,405 | A | 2/1988 | Langford, Jr. |
| 4,763,737 | A | 8/1988 | Hellnick |
| 4,811,801 | A | 3/1989 | Salesky et al. |
| 4,832,139 | A | 5/1989 | Minikus et al. |
| 4,951,762 | A | 8/1990 | Lundell |
| D324,527 | S | 3/1992 | Slutz |
| 5,131,478 | A | 7/1992 | Brett et al. |

(Continued)

FOREIGN PATENT DOCUMENTS

| | | |
|---|---|---|
| EP | 0 391 683 | 10/1990 |

(Continued)

OTHER PUBLICATIONS

Combined Search and Examination Report for Appl. No. GB0717107.7 dated Jan. 8, 2008; (7 p.).

*Primary Examiner*—William P Neuder
*Assistant Examiner*—Brad Harcourt
(74) *Attorney, Agent, or Firm*—Conley Rose, P.C.

(57) ABSTRACT

A drill bit includes a cutter element having a tapered and faceted side surface extending to a peak, and a polygonal wear face that slopes from the peak toward the cutter element base. The cutter element is mounted in a cone cutter of a rolling cone drill bit and, in certain embodiments, is positioned such that, when the cutter element is in a position farthest from the bit axis, the wear face generally faces and is parallel to the borehole sidewall and the peak engages the borehole bottom.

40 Claims, 7 Drawing Sheets

U.S. PATENT DOCUMENTS

| | | | |
|---|---|---|---|
| 5,131,481 | A | 7/1992 | Smith |
| 5,172,777 | A | 12/1992 | Siracki et al. |
| 5,172,779 | A | 12/1992 | Siracki et al. |
| 5,197,555 | A | 3/1993 | Estes |
| 5,201,376 | A | 4/1993 | Williams |
| 5,303,787 | A | 4/1994 | Brady |
| 5,322,138 | A | 6/1994 | Siracki |
| 5,323,865 | A | 6/1994 | Isbell et al. |
| 5,341,890 | A | 8/1994 | Cawthorne et al. |
| 5,351,768 | A | 10/1994 | Scott et al. |
| 5,351,770 | A | 10/1994 | Cawthorne et al. |
| 5,372,210 | A | 12/1994 | Harrell |
| 5,379,854 | A | 1/1995 | Dennis |
| 5,407,022 | A | 4/1995 | Scott et al. |
| 5,415,244 | A | 5/1995 | Portwood |
| 5,421,423 | A | 6/1995 | Huffstutler |
| 5,421,424 | A | 6/1995 | Portwood et al. |
| 5,429,199 | A | 7/1995 | Sheirer et al. |
| 5,429,200 | A | 7/1995 | Blackman et al. |
| 5,452,771 | A | 9/1995 | Blackman et al. |
| 5,467,669 | A | 11/1995 | Stroud |
| 5,479,997 | A | 1/1996 | Scott et al. |
| 5,518,077 | A | 5/1996 | Blackman et al. |
| 5,535,839 | A | 7/1996 | Brady |
| 5,542,485 | A | 8/1996 | Pessier et al. |
| 5,560,440 | A | 10/1996 | Tibbitts |
| 5,592,995 | A | 1/1997 | Scott et al. |
| 5,636,700 | A | 6/1997 | Shamburger, Jr. |
| 5,644,956 | A | 7/1997 | Blackman et al. |
| 5,695,019 | A | 12/1997 | Shamburger, Jr. |
| 5,697,462 | A | 12/1997 | Grimes et al. |
| 5,709,278 | A | 1/1998 | Crawford |
| 5,743,346 | A | 4/1998 | Flood et al. |
| 5,746,280 | A | 5/1998 | Scott et al. |
| 5,752,573 | A | 5/1998 | Scott et al. |
| 5,755,301 | A | 5/1998 | Love et al. |
| 5,766,394 | A | 6/1998 | Anderson et al. |
| 5,813,485 | A | 9/1998 | Portwood |
| 5,819,861 | A | 10/1998 | Scott et al. |
| 5,833,020 | A | 11/1998 | Portwood et al. |
| 5,839,526 | A | 11/1998 | Cisneros et al. |
| 5,871,060 | A | 2/1999 | Jensen et al. |
| 5,874,060 | A | 2/1999 | Armour et al. |
| 5,881,828 | A | 3/1999 | Fischer et al. |
| 5,887,655 | A | 3/1999 | Haugen et al. |
| 5,887,668 | A | 3/1999 | Haugen et al. |
| 5,890,550 | A | 4/1999 | Swadi et al. |
| 5,915,486 | A | 6/1999 | Portwood et al. |
| 5,950,745 | A | 9/1999 | Ingmarsson |
| 5,967,245 | A | 10/1999 | Garcia et al. |
| 6,029,759 | A | 2/2000 | Sue et al. |
| 6,053,263 | A | 4/2000 | Meiners |
| 6,059,054 | A | 5/2000 | Portwood et al. |
| 6,105,693 | A | 8/2000 | Ingmarsson |
| 6,105,694 | A | 8/2000 | Scott |
| D430,578 | S | 9/2000 | Brady |
| 6,119,798 | A | 9/2000 | Fischer et al. |
| 6,176,332 | B1 | 1/2001 | Massa et al. |
| 6,176,333 | B1 | 1/2001 | Doster |
| 6,196,340 | B1 | 3/2001 | Jensen et al. |
| 6,199,645 | B1 | 3/2001 | Anderson et al. |
| 6,202,752 | B1 | 3/2001 | Kuck et al. |
| 6,241,034 | B1 | 6/2001 | Steinke et al. |
| 6,241,035 | B1 * | 6/2001 | Portwood ..... 175/374 |
| 6,367,568 | B2 | 4/2002 | Steinke et al. |
| 6,561,293 | B2 | 5/2003 | Minikus et al. |
| 6,595,305 | B1 | 7/2003 | Dunn et al. |
| 6,601,662 | B2 | 8/2003 | Matthias et al. |
| 6,745,645 | B2 | 6/2004 | Griffo |
| 6,782,959 | B2 * | 8/2004 | Minikus et al. ..... 175/420.1 |
| 6,883,623 | B2 | 4/2005 | McCormick et al. |
| 6,883,624 | B2 | 4/2005 | McDonough |
| 7,011,169 | B2 | 3/2006 | Eason |
| 2001/0004026 | A1 | 6/2001 | Lockstedt et al. |
| 2002/0108789 | A1 * | 8/2002 | Schautt ..... 175/420.1 |
| 2004/0084223 | A1 | 5/2004 | Richman |
| 2004/0094334 | A1 | 5/2004 | Singh |
| 2004/0149493 | A1 | 8/2004 | McDonough |
| 2004/0163851 | A1 | 8/2004 | McDonough et al. |
| 2004/0173384 | A1 | 9/2004 | Yong et al. |
| 2005/0023043 | A1 * | 2/2005 | Tufts ..... 175/374 |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| GB | 2 398 330 | 8/2004 |
| RU | 2105124 | 2/1998 |
| RU | 2153569 | 7/2000 |
| WO | WO 97/48874 | 12/1997 |
| WO | WO 01/61142 | 8/2001 |

* cited by examiner

DRILL BIT WITH CUTTER ELEMENT HAVING MULTIFACETED, SLANTED TOP CUTTING SURFACE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE TECHNOLOGY

The invention relates generally to earth-boring bits used to drill a borehole for the ultimate recovery of oil, gas or minerals. More particularly, the invention relates to rolling cone rock bits and to an improved cutting structure for such bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form a new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability. The form and positioning of the cutter elements upon the cone cutters greatly impact bit durability and ROP, and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. Such wear will shorten the life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing, and ultimately lead to bit failure.

Conventional bits also typically include one or more rows of gage cutter elements. Gage row elements are mounted adjacent to the heel surface but orientated and sized in such a manner so as to cut the corner of the borehole. In this orientation, the gage cutter elements generally are required to cut both the borehole bottom and sidewall. The lower surface of the gage row cutter elements engage the borehole bottom while the radially outermost surface (the surface most distant from the bit axis) scrapes the sidewall of the borehole. Gage row cutter elements have taken a number of forms, including cutter elements having relatively sharp and aggressive cutting portions. For examples, FIGS. 1, 3A in U.S. Pat. No. 5,351,768 disclose the use of sharp, chisel-shaped inserts 51 in the position referred to herein as the "gage row." However, in at least certain hard or abrasive formations, cutter elements having sharp and/or relatively long cutting portions may tend to break or wear prematurely.

Conventional bits also include a number of additional rows of cutter elements that are located on the cones in rows disposed radially inward from the gage row. These cutter elements are sized and configured for cutting the bottom of the borehole and are typically described as inner row cutter elements. In many applications, inner row cutter elements are relatively long and sharper than those typically employed in the gage row or the heel row where the inserts ream the sidewall of the borehole and cut formation via a scraping or shearing action. By contrast, the inner row cutters are intended to penetrate and remove formation material by gouging and fracturing formation material. Consequently, particularly in softer formations, it is desirable that the inner row inserts have a relatively large extension height above the cone steel to facilitate rapid removal of formation material from the bottom of the borehole. However, in hard formations, such longer extensions make the inserts more susceptible to failure due to breakage. Thus, in hard formations, inner row cutter elements commonly have shorter extensions than where employed in soft formation. Nevertheless, it is not uncommon to employ relatively sharp geometry on the inserts in the hard rock formations in order to better penetrate the formation material.

Common cutter shapes for inner row and gage row inserts for hard formations are traditional chisel and conical shapes. Although such inserts with shorter extensions have generally avoided breakage problems associated with longer and more aggressive inserts, and although the relativity sharp chisel and conical shapes provide reasonable rates of penetration and bit life, they tend wear at a fast rate in hard abrasive formations because of the sharp tip geometry which reduces the footage drilled. Increasing ROP while maintaining good cutter and bit life to increase the footage drilled is still an important goal so as to decrease drilling time and the enormous costs associated with drilling, and to thereby recover valuable oil and gas more economically.

Accordingly, there remains a need in the art for a drill bit and cutting structure that, in relatively hard and/or highly abrasive formations, will provide an increase in ROP and footage drilled, while maintaining a full gage borehole.

SUMMARY OF THE PREFERRED EMBODIMENTS

Accordingly, there is provided herein a rolling cone drill bit and a cutter element for use in such bit where, in certain embodiments, the cutter element includes a generally planar top surface or wear face that is generally polygonal in shape and that slopes from a peak toward the cutter element base, the cutting portion of the cutter element including a faceted side surface having three or more facets extending between the base and the wear face. The wear face may be triangular, trapezoidal, rectangular or other polygonal shape and, depending upon the application, is preferred to slope relative to the cutter element axis at an angle of between about 40° and 80°. The intersection of the wear face and the faceted side surface forms a radiused edge that extends around the perimeter of the wear face. Preferably, the polygonal shape includes rounded corners. In certain embodiments, the rounded corners will differ in radius with one or more of the corners being sharper than others. Preferably, the cutting surface of the cutter element is tapered in all profile views. Also, to provide the desired polygonal-shaped wear face, the facets are generally planar in certain embodiments. However, in other embodiments, the facets may be slightly convex or slightly concave, thereby providing corners with differing degrees of sharpness compared to the cutting surface having planar facets.

In certain embodiments, the cutter element is mounted in a rolling cone of a drill bit and is oriented such that the wear face generally faces the borehole sidewall when the cutter element is in its lowermost position, i.e., the position where the cutter element is farthest from the bit axis. In certain embodiments, the corners of the polygonal cutting face that are closest to the borehole sidewall and farthest from the bit axis are formed to be sharper than the corners positioned in other locations. In this manner, as the rolling cone cutter rotates and the insert first engages the borehole sidewall, the sidewall will be attacked first by a relatively sharp corner and the bottom of the borehole engaged by a corner having a more rounded or blunt edge so as to resist breakage in relatively hard formations.

In certain embodiments described herein, the cutter element will include a ratio of extension height to diameter of not greater than 0.75. The combination of sloping polygonal-shaped wear face, in combination with a moderate extension height, provides a relatively broad and breakage-resistant wear face for reaming the borehole sidewall, but one with corners and edges desirable for shearing enhancement as the insert first engages formation material. The relatively short extension height, relative to conventional and longer chisel-shaped and conical inserts, is intended to provide a robust and breakage-resistant element.

The embodiments described herein thus comprise a combination of features and characteristics intended to address various shortcomings of prior bits and inserts. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
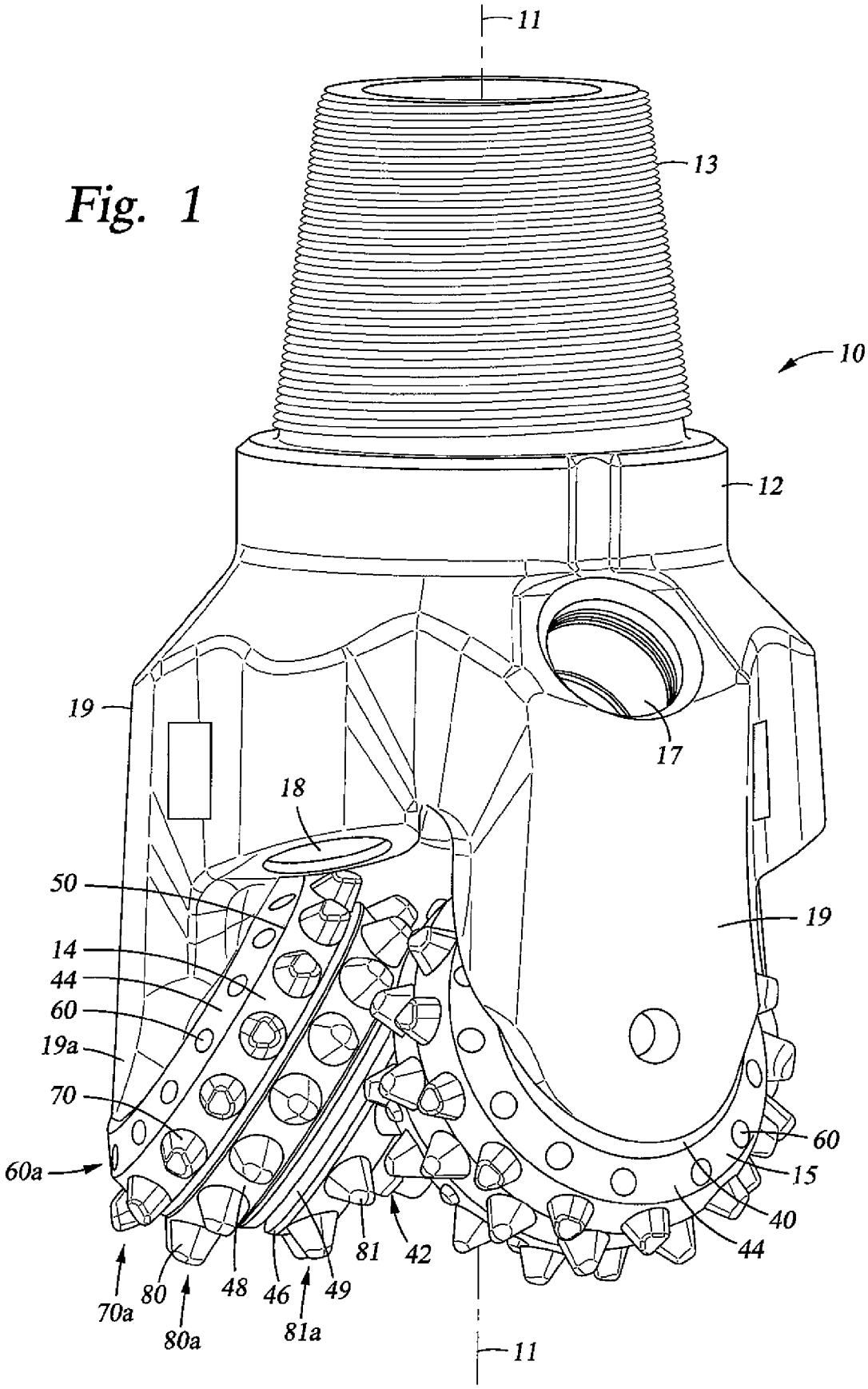
FIG. 1 is an elevation view of an earth-boring bit made in accordance with the principles of the present invention.

Referring first to FIG. 1, an earth-boring bit 10 includes a central axis 11 and a bit body 12 having a threaded section 13 on its upper end for securing the bit to the drill string (not shown). Bit 10 has a predetermined gage diameter as defined by three rolling cone cutters 14, 15, 16 (two shown in FIG. 1) rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 14-16, and lubricant reservoirs 17 that supply lubricant to the bearings of each of the cutters. Bit legs 19 include a shirttail portion 19*a* that serves to protect cone bearings and seals from damage caused by cuttings and debris entering between the leg 19 and its respective cone cutters.

Figure 2:
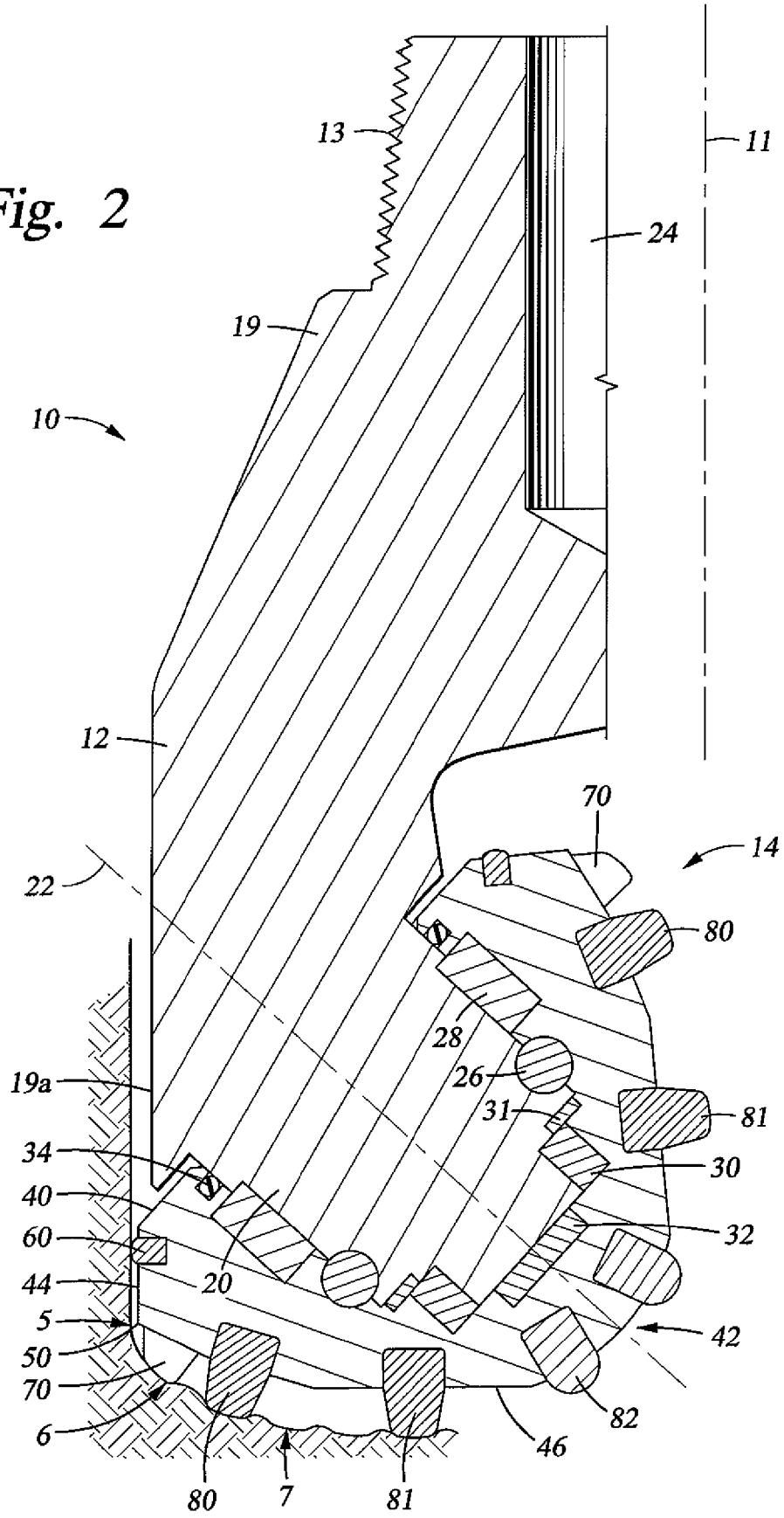
FIG. 2 is a partial section view taken through one leg and one rolling cone cutter of the bit shown in FIG. 1.
Figure 3:
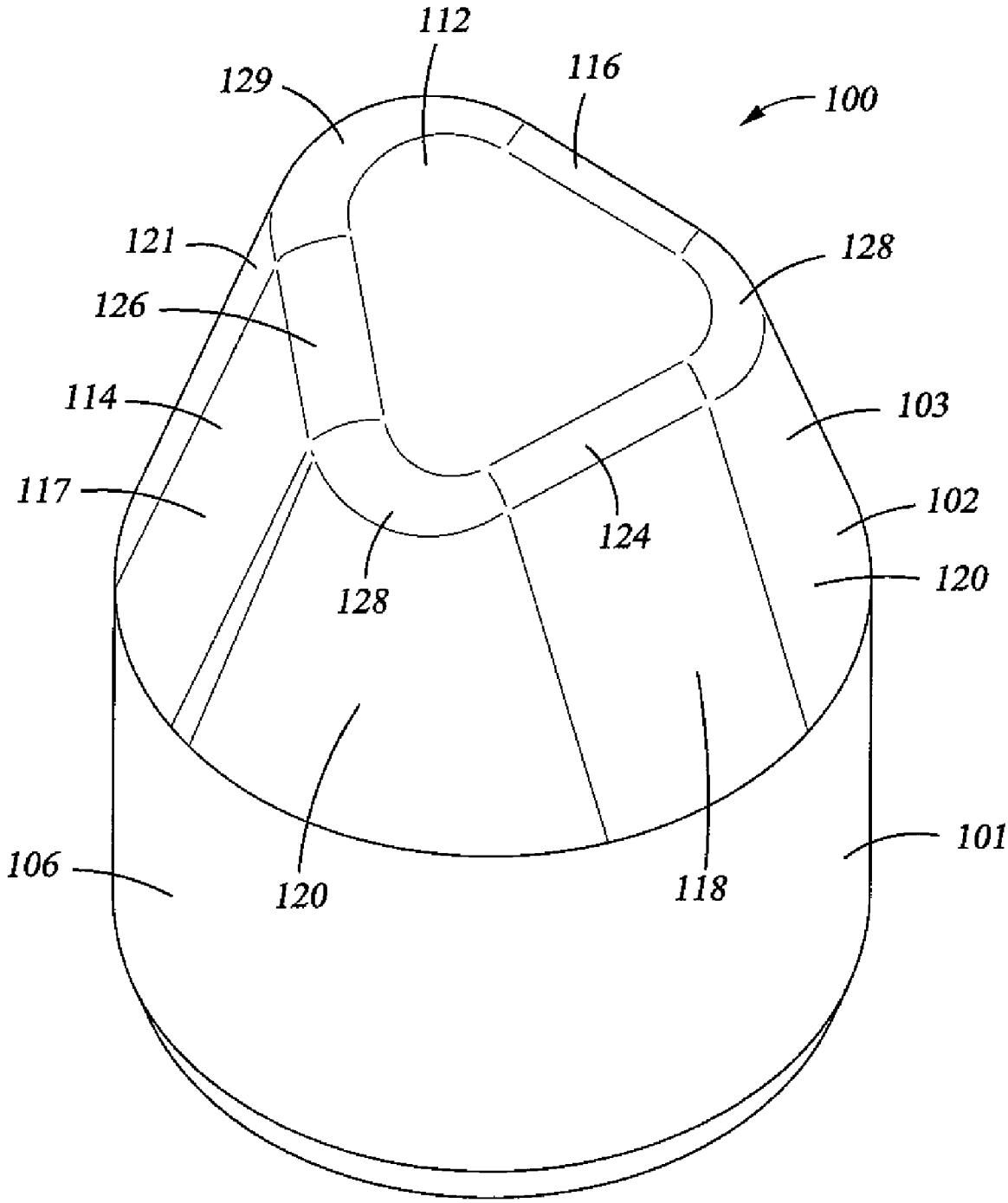
FIG. 3 is a perspective view of a cutter element insert for use in the drill bit of FIG. 1.

Referring now to FIG. 2, in conjunction with FIG. 1, each cone cutter 14-16 is rotatably mounted on a pin or journal 20, with an axis of rotation 22 oriented generally downwardly and inwardly toward the center of the bit. Drilling fluid is pumped from the surface through fluid passage 24 where it is circulated through an internal passageway (not shown) to nozzles 18 (FIG. 1). Each cone cutter 14-16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit, where cone cutters 14-16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2.

Referring still to FIGS. 1 and 2, each cone cutter 14-16 includes a backface 40 and nose portion 42. Further, each cone cutter 14-16 includes a generally frustoconical surface 44 that is adapted to retain cutter elements that scrape or ream the sidewalls of the borehole as cone cutters 14-16 rotate about the borehole bottom. Frustoconical surface 44 will be referred to herein as the "heel" surface of cone cutters 14-16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters 14-16 rotate about the borehole. Conical surface 46 typically includes a plurality of generally frustoconical segments 48 generally referred to as "lands" which are employed to support and secure the cutter elements as described in more detail below. Grooves 49 are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each cone cutter 14-16 includes a plurality of wear resistant cutting elements or inserts 60, 70, 80-82. Exemplary cone cutter 14 illustrated in FIG. 2 includes a plurality of heel row inserts 60 that are secured in a circumferential row 60*a* in the frustoconical heel surface 44. Cone cutter 14 further includes a circumferential row 70*a* of gage inserts 70 secured to cone cutter 14 in locations along or near the circumferential shoulder 50. Cone cutter 14 further includes a plurality of inner row cutter elements or inserts 80, 81, 82 secured to cone surface 46 and arranged in spaced-apart inner rows 80*a*, 81*a*, 82*a*, respectively. Bit 10 may include additional rows of inner row cutter elements in addition to rows 80*a*, 81*a*, 82*a*. Heel inserts 60 generally function to scrape or ream the borehole sidewall 5 to maintain the borehole at full gage, to prevent erosion and abrasion of heel surface 44, and to protect the shirttail portion 19*a* of bit leg 19. Inserts 80-82 of inner rows 80*a*-82*a* are employed primarily to gouge or crush and remove formation material from the borehole bottom 7. Inner rows 80*a*-82*a* of cone cutter 14 are arranged and spaced on cone cutter 14 so as not to interfere with the inner rows on each of the other cone cutters 15, 16. Gage cutter elements 70 cut the corner of the borehole and, as such, performs sidewall cutting and button-hole cutting.

Inserts 60, 70, 80-82 each include a base portion and a cutting portion. The base portion of each insert is disposed within a mating socket drilled or otherwise formed in the cone steel of a rolling cone cutter 14-16. Each insert may be secured within the mating socket by any suitable means including without limitation an interference fit, brazing, or combinations thereof. The cutting portion of an insert extends from the base portion of the insert and includes a cutting surface for cutting formation material. The present disclosure will be understood with reference to one such cone cutter 14, cone cutters 15, 16 being similarly, although not necessarily identically, configured.

Cutter element insert 100 is shown in FIGS. 3-6. Insert 100 is particularly suited for use as a gage row cutter element 70 shown in FIGS. 1-2. Insert 100 is made of tungsten carbide or other hard materials through conventional manufacturing procedures, and includes a base portion 101 and a cutting portion 102 extending therefrom. Cutting portion 102 includes cutting surface 103 and intersects base portion 101 at a plane of intersection 110.

Base portion 101 is the portion of insert 100 disposed within the mating socket provided in the cone steel of a cone cutter. Thus, as used herein, the term "base portion" refers to the portion of a cutter element or insert (e.g., insert 100) disposed within mating socket provided in the cone steel of a cone cutter (e.g., cone cutter 14). Further, as used herein, the term "cutting portion" refers to the portion of a cutter element or insert extending from the base portion. It should be understood that since the cutting portion extends from the base portion, and the base portion is disposed within the cone steel of a rolling cone cutter, the cutting portion is that portion of the insert extending beyond the cone steel of the rolling cone cutter.

Base portion 101 is generally cylindrical and includes central axis 107, bottom surface 104 and a substantially cylindrical side surface 106 extending upwardly therefrom. The cylindrical side surface 106 and the bottom surface 104 intersect at a chamfered corner 108 which facilitates insertion and mounting of insert 100 into the receiving aperture formed in the cone steel. Base portion 101 and insert 100 as a whole include a diameter D as shown. Although base portion 101 is cylindrical having a circular cross-section in this embodiment, base portion 101 may likewise have a non-circular cross-section (e.g., cross-section of the base portion 101 may be oval, rectangular, asymmetric, etc.).

Insert 100 is retained in the cone steel up to the plane of intersection 110, with the cutting portion 102 extending beyond the cone steel by an extension height E. Thus, as used herein, the term "extension," "extension height," or "extension height E" refers to the axial length that a cutting portion extends beyond the cone steel. Further, at least a portion of the surface of base portion 101 is coupled to the cone steel of the mating socket within which base portion 101 is retained. Thus, as used herein, the term "grip," "grip length," or "grip G" refers to the axial length of the base portion of an insert that is coupled to the cone steel.

Cutting surface 103 includes a generally flat or planar polygonal-shaped top surface 112, faceted side surfaced 114, and peak 122. The faceted side surface 114 extends from base 101 to top surface 112 and includes, in this embodiment, three generally planar surfaces, best described as facets 117-119. Having three facets, the cutting surface 103, in this embodiment, forms a top surface 112 that is generally triangular-shaped, as best shown in the top view of FIG. 6.

Top surface 112, which may also be referred to herein as a "wear face," is generally bounded by lower radiused edge 124 that is opposite from peak 122, and a pair of radiused edges 126, each of which extends between one end of lower radiused edge 124 and peak 122. Radiused edges 124, 126 form a radiused transition 116 which forms the perimeter of top surface 112 and blends or transitions cutting surface 103 between the faceted side surface 114 and top surface 112. As measured between side surface 114 and top surface 112, the radius of edges 124, 126 is approximately 0.050 inches in this example for insert 100 having a diameter D of approximately 0.5 inches and an extension height H of approximately 0.780 inches. Eliminating abrupt changes in curvature or small radii between adjacent regions on the cutting surface lessens undesirable areas of high stress concentrations which can cause or contribute to premature cutter element breakage. Accordingly, the cutting surface 103 is continuously contoured or sculpted to reduce such high stress concentrations. As used herein, the terms "continuously contoured" or "sculpted" refer to cutting surfaces that can be described as continuously curved surfaces wherein relatively small radii (less than 0.080 inches) are used to break sharp edges or round off transitions between adjacent distinct surfaces as is typical with many conventionally-designed cutter elements.

Figure 4:
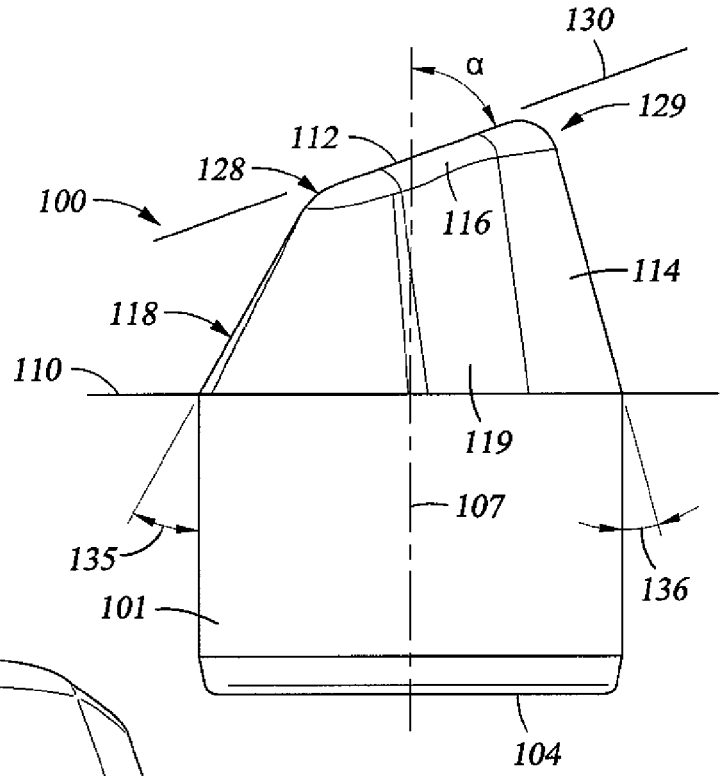
FIG. 4 is a side elevation view of the insert shown in FIG. 3.
Figure 5:
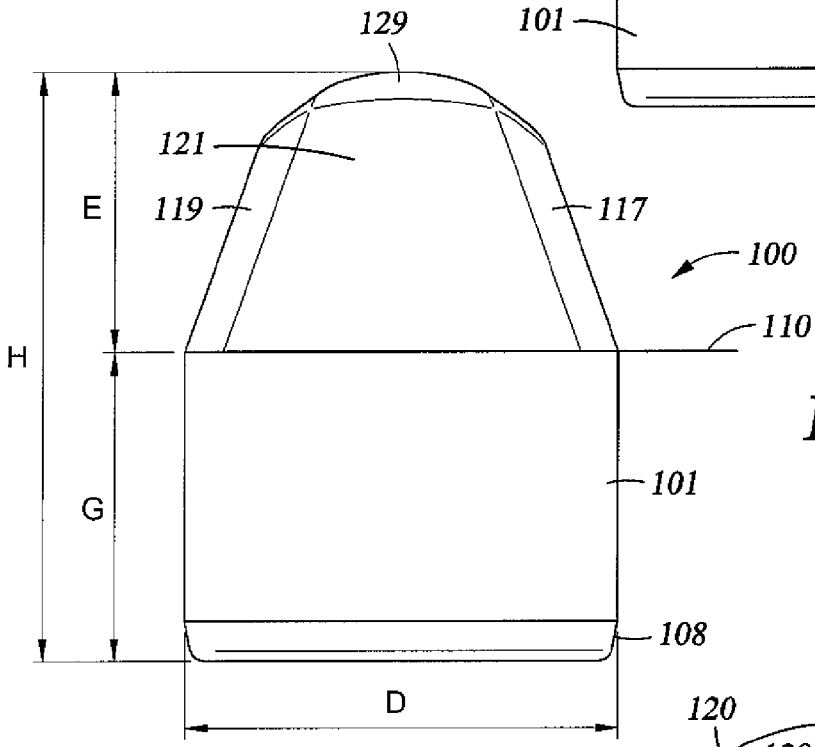
FIG. 5 is an end elevation view of the insert shown in FIG. 3, this view shown looking in a direction 90° opposed to that of FIG. 4.

Facets 117-119 are generally planar, but need not be absolutely flat. For example, facets 117-119 may be slightly convex or slightly concave as described below. Given the substantially planar facets 117-119 of this embodiment, the intersection of facets 117-119 with generally flat top surface 112 provide edge segments 124, 126 that extend generally linearly. Faceted side surface 114 further includes transitional corner surfaces 120, 121. One such transitional corner surface 120 extends between facets 117 and 118 and another between facets 118 and 119. Transitional corner surface 121 extends between facets 117 and 119. As shown in FIGS. 4, 5, each transitional corner surface 120, 121 tapers in profile view as it extends from base 101 to top surface 112. Further, as shown in the top view of FIG. 6, each transitional corner surface 120, 121 is generally convex or outwardly bowed as it extends between adjacent facets.

Top surface 112 slopes between peak 122 and lower radiused edge 124 along reference plane 130 and thereby intersects insert axis 107 at an angle $\alpha$ that is preferably an angle other than 90°. In the embodiment shown in FIG. 4, $\alpha$ is approximately 70°. Given that reference plane 110 is generally perpendicular to axis 107, top surface 112 is angled relative to reference plane 110 at an angle of 90°-$\alpha$. Although depending upon the characteristics of the formation being drilled, and other factors, it is preferred that $\alpha$ be generally within the range of approximately 40° to approximately 80°.

Figure 6:
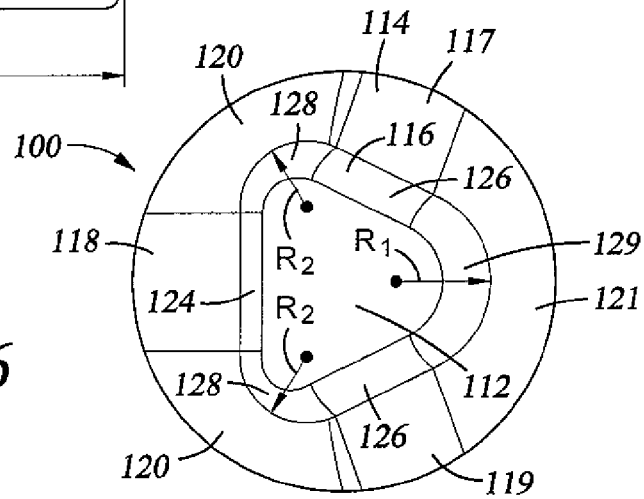
FIG. 6 is a top view of the insert shown in FIGS. 3 and 4.

The generally triangular top surface or wear face 112 has rounded corners 128 at the intersection of lower edge 124 and edge 126, and a rounded corner 129 at the intersection of edges 126, adjacent to peak 122. In this example, and as best shown in FIG. 6, the radius $R_1$ at rounded corner 129 is greater than the radius $R_2$ of rounded corners 128. In this manner, corners 128 may be described as being sharper than corner 129. As used herein to describe a portion of a cutter element's cutting surface, the term "sharper" indicates that either (1) the angle defined by the intersection of two lines or planes or (2) the radius of curvature of a curved surface, is smaller than a comparable measurement on a portion of the cutting surface to which it is compared, or a combination of features (1) and (2). In this example, $R_1$ is approximately 0.130 inches and $R_2$ is approximately 0.100 inches.

As best shown in the profile view of FIG. 4, facet 118 tapers toward insert axis 107 at angle 135 that, in this embodiment, is approximately 30°. Likewise, in profile, transitional corner surface 121 tapers towards insert axis 107 at an angle 136 that is less than angle 135. In this example, angle 136 is approximately 10°. As understood with reference to FIGS. 4 and 5, faceted side surface 114 tapers from base 101 toward insert axis 107 when viewed in any profile (i.e., viewed perpendicular to axis 107). Accordingly, faceted side surface 114 and cutting surface 103 may each be described as tapered continuously along its outer profile or tapered in all profile views.

Cutting portion 102 is relatively blunt and less aggressive compared to certain conventional inner row and gage inserts which include much longer, sharper, or more pointed cutting tips. In this specific example, the extension height E of insert 100 is approximately 0.3 inches, such that the ratio of extension height E-to-diameter D is 0.6. It is preferred that insert 100 have a ratio of extension height E-to-diameter D not greater than 0.75 and, more preferably, not greater than 0.65. As previously mentioned, certain conventional gage and inner row inserts are substantially longer and sharper than the insert 100 shown in FIGS. 3-6. However, while insert 100 is tapered from a relatively wide base to a more narrow cutting tip at peak 122, a substantial volume of insert material is nevertheless provided near peak 122 so as to provide a robust and durable cutting element.

Certain of the features and geometries previously described with reference to FIGS. 3-6 provide a relatively blunt cutter element 100 that is believed to have particular utility in the gage row of a rolling cone cutter. As previously described, the gage row performs both side wall and bottom hole cutting duty and helps define and maintain the full gage diameter of the borehole. Without limiting the application of the insert 100 described above, it is believed that insert 100 is particularly well-suited for drilling in granites, sandstones, siltstones and conglomerates.

Figure 7:
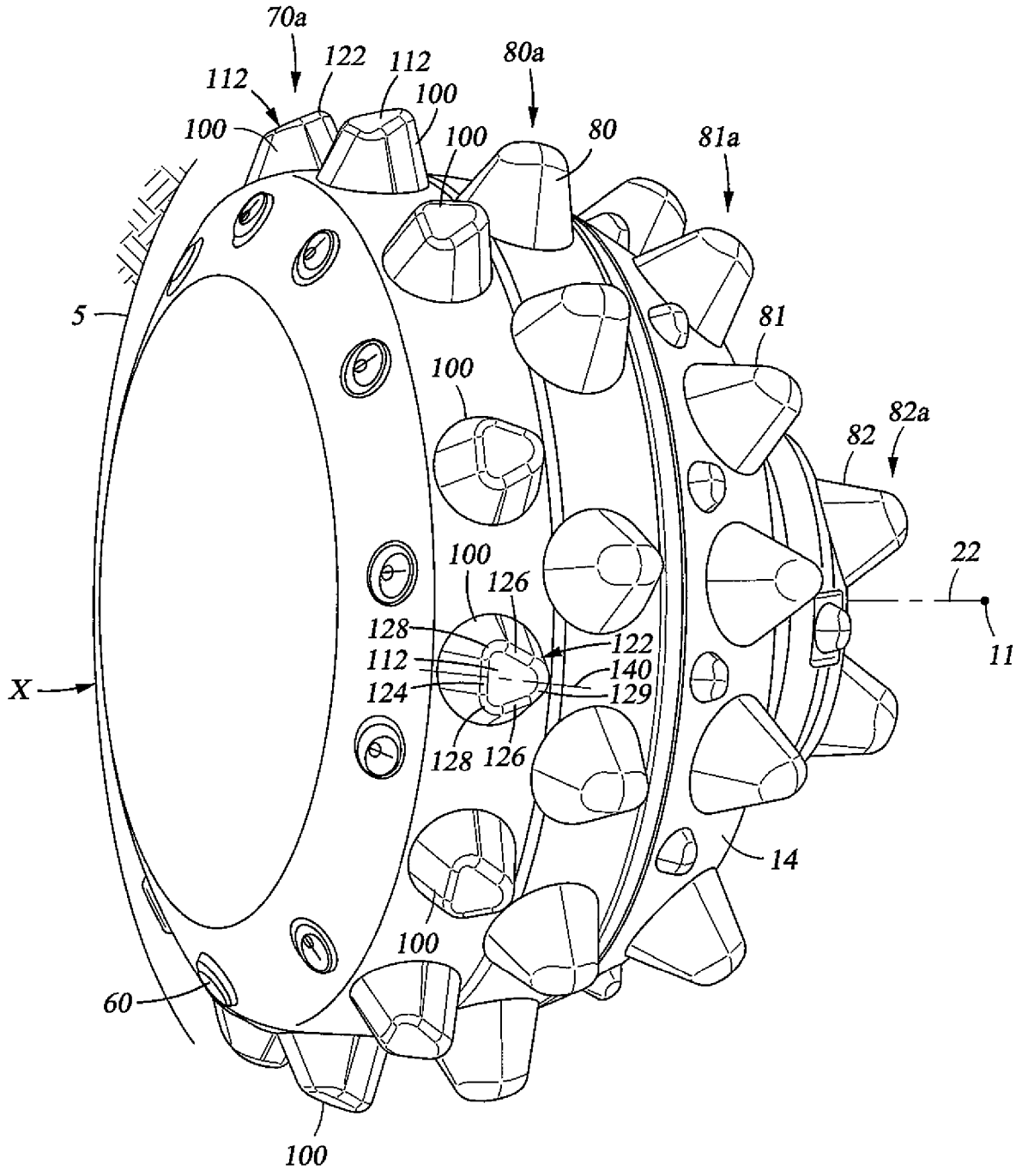
FIG. 7 is a perspective view of one cone cutter of the rolling cone bit shown in FIG. 1 as viewed along the bit axis from the pin end of the bit.

An enlarged view of rolling cone cutter 14 is shown in FIG. 7. As shown, the cone cutter 14 includes a gage row **70*a* having a plurality of inserts 100 circumferentially arranged about the cone, and inner row 80*a* adjacent thereto. Inserts 100, in this example, are oriented such that a projection of a median line 140 that bisects corner 129 is aligned with cone axis 22. In other embodiments, insert 100 may be rotated relative to the orientation shown in FIG. 7 and, in such embodiments, the projection of median line 140 would be skewed relative to cutter axis 122. In the embodiment shown in FIG. 7, however, the top surface 112 is generally parallel to and faces the borehole sidewall 5 when insert 100 is at its position closest to the borehole bottom, and farthest from the bit axis 11, position "x" as denoted in FIG. 7. In this lowermost and outermost position "x," and given this orientation of insert 100, peak 122 extends to the full gage diameter of the borehole and is positioned to engage the borehole bottom 7 (FIG. 2) so that, relative to the generally planar cutting surface 112, peak 122 presents a sharper cutting surface for cutting the borehole bottom. At the same time, the generally flat and broad cutting surface 112 provides the scraping and reaming function for cutting the borehole sidewall 5. Further, as shown in FIG. 7, insert 100 is oriented such that the relatively sharper corners 128 are disposed closer to the borehole sidewall, whereas corner 129 having the larger radius is closer to the bit axis 11. Corners 128 provide for enhanced cutting of the borehole sidewall as they approach the sidewall. The corners 128, 129 of insert 100 provide a more aggressive geometry than a more rounded cutting insert that lacks such corners and that lack the polygonal wear face 112. As the insert 100 approaches the sidewall, it approaches first with a corner 128 that, along with radiused edges 124, 126 provide a shearing action. At the same time, wear face 112 provides a resistance to breakage or other failure as might result from a cutting insert lacking the relatively broad, flat cutting surface 112** that extends generally parallel to the borehole sidewall in profile.

Additional wear-resistance may be provided to the cutting inserts described herein. In particular, portions or all of the cutting surfaces of inserts 100 as examples, may be coated with diamond or other super-abrasive material in order to optimize (which may include compromising) cutting effectiveness and/or wear-resistance. Super abrasives are significantly harder than cemented tungsten carbide. As used herein, the term "super abrasive" means and includes polycrystalline diamond (PCD), cubic boron nitride (CBN), thermal stable diamond (TSP), polycrystalline cubic boron nitride (PCBN), and any other material having a material hardness of at least 2,700 Knoop (kg/mm2). As examples, PCD grades have a hardness range of about 5,000-8,000 Knoop (kg/mm2) while PCBN grades have hardnesses which fall within the general range of about 2,700-3,500 Knoop (kg/mm2). By way of comparison, conventional cemented tungsten carbide grades typically have a hardness of less than 1,500 Knoop (kg/mm2). In certain embodiments, the entire cutting surface 103 is coated with a superabrasive. In other embodiments, top surface 112 includes superabrasive, but the faceted side surface does not. Certain methods of manufacturing cutting elements with PCD or PCBN coatings are well known. Examples of these methods are described, for example, in U.S. Pat. Nos. 5,766,394, 4,604,106, 4,629,373, 4,694,918, and 4,811,801, the disclosures of which are all incorporated herein by this reference.

Figure 9:
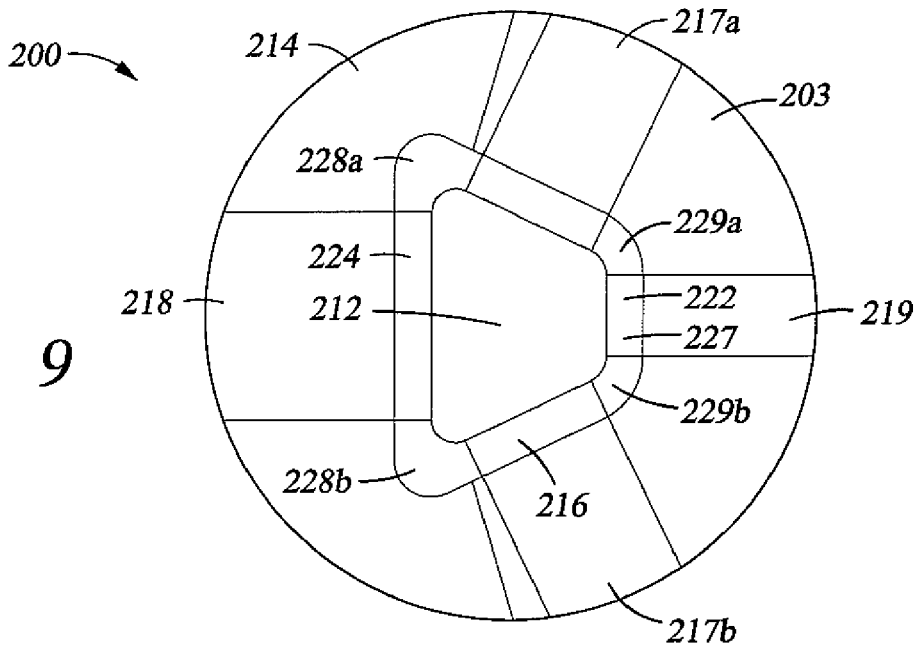
FIG. 9 is a top view of the cutter element of FIG. 8.
Figure 8:
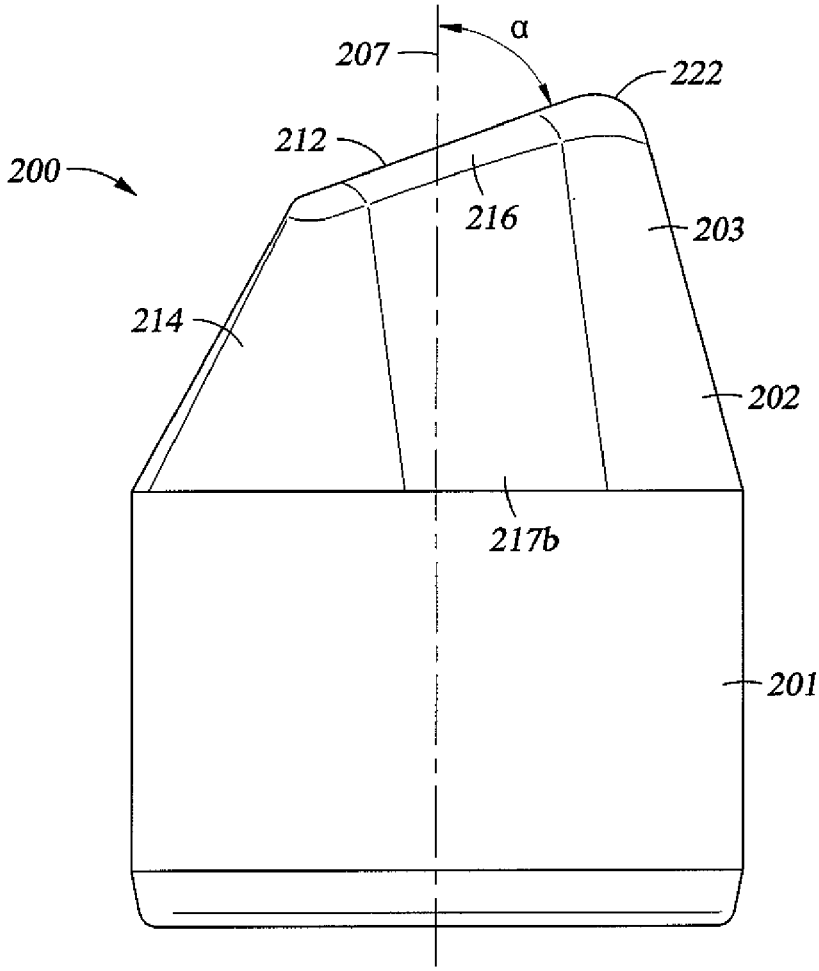
FIG. 8 is a side elevation view of an alternative cutter element insert for use in the drill bit of FIG. 1.

Referring now to FIGS. 8 and 9, another cutter element 200 is shown which, like insert 100, is believed to have particular utility when employed in the gage row of a roller cone bit, particularly in hard or abrasive formations. The cutter element 200 includes a base 201 as previously described with reference to insert 100 in FIGS. 3-6, and a cutting portion 202 with cutting surface 203 that is similar to the corresponding features of insert 100. More particularly, cutting surface 203 includes peak 222, a faceted side surface 214 and a slanted top surface 212 which intersects side surface 214 in a radiused transition 216. Top surface 212 is sloped at an acute angle $\alpha$ relative to insert axis 207. In this embodiment, faceted side surface 214 includes four facets such that generally planar top surface 212 forms a polygon having a generally trapezoidal shape. More particularly, facets 217*a, b*, 218, and 219 tapered inwardly towards the insert axis 207 as they extend from the base to the top cutting surface 212. Facet 218 is generally wider than facet 219 such that radiused edge 224 is longer than the radiused edge 227 that is opposite it. Top surface 212 and transition 216 define corners 228*a*, b and 229*a, b*. Corners 229*a, b*, in this embodiment, have a radius that is larger than the radius of corners 228*a, b*. Although insert 200 may be employed in other orientations, at least in one embodiment, insert 200 is disposed in a gage row 70*a* of a cone cutter such as rolling cone 14 (FIG. 7) and oriented such that cutting surface 212 is generally parallel to the borehole sidewall, and such that peak 222 is positioned so as to engage the borehole bottom, when the insert is in a position farthest from the bit axis. In this orientation, the relatively sharp corners 228*a, b* provide an aggressive cutting feature as the insert rotates into engagement with the borehole sidewall, while cutting surface 212 provides a relatively broad and flat cutting surface for scraping and reaming the sidewall.

Figure 10:
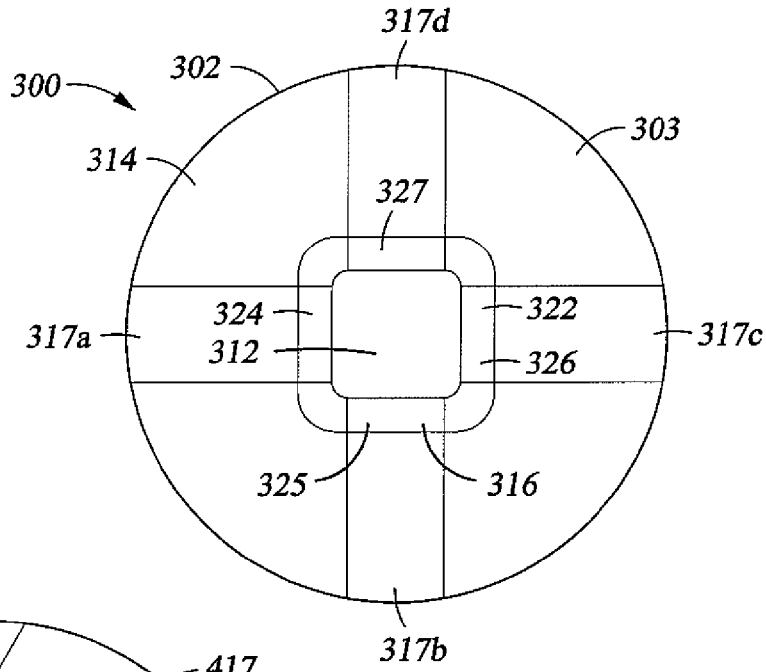
FIG. 10 is a top view of another alternative cutting insert for use in the drill bit of FIG. 1.

Referring now to FIG. 10, an insert 300 is shown that is similar is certain regards to inserts 100, 200 previously described. In this embodiment, insert 300 includes a cutting portion 302 having a cutting surface 303 that extends upwardly from base portion to a peak 322. The cutting surface 303 includes a faceted side surface 314 having four facets 317*a-d* and a sloping and generally planar top surface 312. Top surface 312 slopes downwardly from peak 222 and intersects faceted side surface 314 forming radiused edges 324-327. In this embodiment, facets 317*a-d* generally have the same width and they are angularly spaced approximately 90° apart. Radiused edges 324-332, forming transition 316 that blends and contours between faceted side surface 314 and top surface 312, form a polygon generally in the form of a rectangle.

By varying angle $\alpha$, or by varying the width of the facets, or by varying the angular position of the facets about the cutting surfaces, or by various of these techniques, the shape of the polygonal top cutting surface 112, 212, 312 described herein can be altered. By way of example only, decreasing angle $\alpha$ (FIG. 4) has the effect of generally lengthening lower radiused edge 124. Likewise, increasing the width of facet 118 tends to increase the length of radiused edge 124. Thus, the bit designer is provided with various means by which to accomplish the insert shape that is desired, one with a cutting surface having a generally polygonal, sloped top surface that intersects with faceted sides providing corners and edges for shearing, and a generally planar wear face for reaming.

Figure 11:
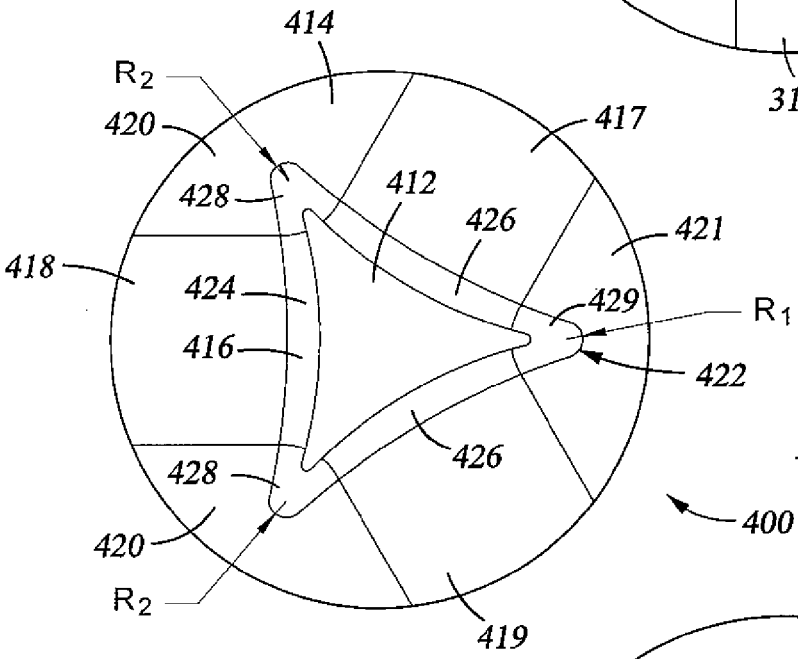
FIG. 11 is a top view of another alternative cutting insert for use in the drill bit of FIG. 1.

Referring to FIG. 11, insert 400 is shown which is generally similar to insert 100 previously described. Insert 400 includes a cutting portion 402 having a cutting surface 403 that extends upwardly and away from base portion 401 to a peak 422. Cutting surface 403 includes faceted side surface 414 having facets 417-419 which extend from the base to a generally flat or planar top surface or wear face 412. Faceted side surface 414 includes transitional corner surfaces 420, 421, each tapering continuously along their outer profiles toward the insert axis 407. It is preferred that wear face 412 slope from a highest point adjacent corner 429 to a lowest point adjacent edge surface 424, corner 429 establishing a peak 422 for insert 400. Also, in this embodiment, as distinguished from the embodiment described with reference to FIGS. 3-6, facets 117-119 are slightly concave. As such, the radiused edges 424, 426 bounding and forming the perimeter of wear face 412 includes corners 428, 429 that may be formed to be sharper than the corners of insert 100 in which facets 117-119 are generally planar and the segments 124, 126 generally linear. In the embodiment shown in FIG. 11, corner 429 has a radius $R_1$ and each of corners 428 has a radius $R_2$. In this embodiment, $R_1$ is greater than $R_2$. As an example $R_1$ may be equal to 0.100 inch and $R_2$ equal to 0.080 inch, for an insert having the same extension height and diameter of the insert 100 previously described. Insert 400, when formed to have corners that are sharper than those described with reference to insert 100 of FIGS. 3-6, may be advantageous in formations softer than those in which insert 100 is to be employed.

Figure 12:
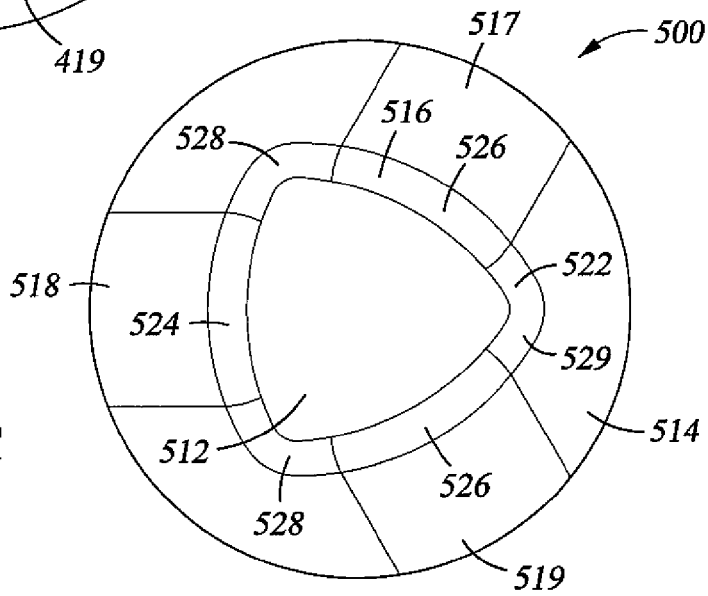
FIG. 12 is a top view of another alternative cutting insert for use in the drill bit of FIG. 1.

Another cutter element 500 is shown in FIG. 12 and is generally similar to insert 400 shown in FIG. 11. Polygonal upper surface 512 of insert 500 is generally planar and sloped from a peak 522 adjacent corner 529 to lower edge 524 of transition 516. However, insert 500 includes faceted side surface 514 having facets 517-519 that are slightly convex as compared to being substantially planar (as with insert 100 of FIGS. 3-6) or slightly concave (as with insert 400 shown in FIG. 11). Due to the slightly convex nature of facets 517-519, the radiused edge segments 524, 526 are bowed outwardly and thus non-linear, such that corners 428, 429 are generally less sharp (i.e., have a larger radius) than those corresponding corners of insert 400 (FIG. 11) and insert 100 (FIG. 6).

In each of these examples, the top cutting surface 412, 512 still possesses what may be described as a generally triangular shape. As discussed with reference to FIGS. 8-10, by varying the number of facets, as well as the width of and relative spacing between the facets, the shape of the top cutting surface or wear face 412, 512 may be varied to take on polygonal shapes other than triangular, such as the generally trapezoidal shape shown with respect to insert 200 of FIG. 9.

An insert such as that shown in FIG. 11 or 12 may be disposed in various locations in a rolling cone cutter but, in particular, is believed to have utility when used in the gage row, such as gage row 70*a*, shown in FIGS. 1 and 2. As such, it is preferred that the cutter elements 400, 500 be oriented such that their generally flat, wear faces 412, 512, respectively, are positioned generally parallel to the borehole sidewall when the cutter element is in its position farthest from the drill bit axis and closest to the borehole bottom.

While preferred embodiments of this invention have been shown and described, modifications thereof can be made by one skilled in the art without departing from the spirit or teaching herein. The embodiments described herein are exemplary only and are not limiting. Many variations and modifications of the system and apparatus are possible. Accordingly, the scope of protection is not limited to the embodiments described herein, but is only limited by the claims which follow, the scope of which shall include all equivalents of the subject matter of the claims.

What is claimed is:

1. A rolling cone drill bit for drilling a borehole having a gage diameter and a borehole bottom and a borehole sidewall, the bit comprising:

a bit body having a bit axis;

at least one rolling cone cutter mounted on the bit body for rotation about a cone axis and having a first surface for cuffing the borehole bottom and second surface for cutting the borehole sidewall;

a plurality of cutter elements secured to said cone cutter;

at least a first of said cutter elements comprising a base portion retained in said cone cutter, and a cutting portion extending in a first direction from said base portion to a peak;

wherein said cutting portion comprises a generally planar surface having a generally polygonal shape and sloping from said peak toward said base;

wherein said generally polygonal shape includes a first corner adjacent the peak, a first side extending from the first corner towards the base, and a second side extending from the first corner towards the base, wherein the second side diverges from the first side as it extends towards the base;

wherein said cuffing portion further comprising a side surface having three or more facets extending between said base and said generally planar surface.

2. The rolling cone drill bit of claim 1 wherein said generally polygonal shape includes a plurality of corners, and wherein said first cutter element is positioned in said cone cutter such that a projection of a median line bisecting one of said corners lies along said cone axis.

3. The rolling cone drill bit of claim 1 wherein said first cutter element is mounted in said cone cutter such that said generally planar surface is generally parallel to the borehole sidewall when said first cutter element is in a position farthest from the bit axis and closest to the borehole sidewall.

4. The rolling cone drill bit of claim 3 wherein said cutter element is positioned in a gage row and said peak extends to full gage diameter.

5. The rolling cone drill bit of claim 1 wherein said first cutter element further includes a radiused edge at the perimeter of said generally planar surface, said edges forming rounded corners of said polygonal shape and wherein said corners differ in radius.

6. The rolling cone drill bit of claim 5 wherein said generally planar surface is generally triangular in shape, and includes a radiused edge including the first corner that is sharper than a second corner; and wherein said first cutter element is mounted in said cone cutter such that said first corner is closer to the borehole sidewall and said second corner is closer to said bit axis.

7. The rolling cone drill bit of claim 5 wherein the radius of the first corner adjacent the peak is greater than the radius of any other corner of the polygonal shape.

8. The rolling cone drill bit of claim 1 wherein said planar surface is generally trapezoidal in shape.

9. The rolling cone drill bit of claim 1 wherein, relative to said first direction, said generally planar surface slopes at an angle of between approximately 40° and 80°.

10. The rolling cone drill bit of claim 1 wherein said first cutter element includes an extension height and a base diameter, and wherein the ratio of extension height to base diameter is not greater than 0.75.

11. The rolling cone drill bit of claim 1 wherein said cutting portion of said first cutter element, between said base and said peak is tapered in all profile views.

12. A rolling cone drill bit for drilling in earthen formations and forming a borehole having a borehole sidewall, a borehole bottom, and a borehole corner, the bit comprising:

a bit body disposed about a bit axis;

at least one rolling cone cutter mounted on said bit body for rotation about a cone axis;

a plurality of cutter elements secured to said cone cutter and positioned to cut the corner of the borehole;

said cutter elements comprising a base portion mounted in said cone cutter and a cutting portion extending from said base portion, said cutting portion comprising a peak and a cutting surface having a slanted and generally planar wear face; and said cutting surface further comprising a side surface extending from said base to said wear face, said side surface including three or more facets and intersecting said wear face in an edge forming a generally triangular-shaped perimeter of said wear face having a first corner adjacent the peak, a second corner distal the peak, and a third corner distal the peak.

13. The drill bit of claim 12 wherein said cutter elements are mounted in said cone cutter such that said wear face generally faces the borehole sidewall when said cutter elements are farthest from the drill bit axis.

14. The drill bit of claim 12 wherein said side surface includes four facets.

15. The drill bit of claim 12 wherein said cutter elements include an axis and wherein said wear face is sloped relative to said axis at an angle between approximately 40° and 80°.

16. The drill bit of claim 12 wherein each of said corners of said triangular-shaped perimeter are rounded corners that differ in radius; and wherein said cutter elements are mounted in said cone cutter such that the second corner that is sharper than the first corner is farther from the borehole bottom than said first corner when said cutter elements are farthest from the drill bit axis.

17. The rolling cone drill bit of claim 16 wherein the radius of the first corner adjacent the peak is greater than the radius of any other corner of the wear face.

18. The drill bit of claim 12 wherein at least one of said plurality of cutter elements include at least two facets having a curvature selected from the group of slightly concave and slightly convex.

19. The drill bit of claim 12 wherein said plurality of cutter elements are mounted in said cone cutter such that a projection of a median line that bisects a corner of the triangular shape is substantially aligned with said cone cutter axis.

20. The drill bit of claim 12 wherein said cutter elements include an extension height and a base diameter, and wherein the ratio of said extension height to said base diameter is not greater than 0.75.

21. A cutter element for use in a rolling cone drill bit, comprising:

a base portion and a cutting portion extending in a first direction from said base portion to a peak, said cutting portion comprising a generally planar surface having a generally polygonal shape and sloping from said peak toward said base;

wherein said generally polygonal shape includes a first corner adjacent the peak, a first side extending from the first corner towards the base, and a second side extending from the first corner towards the base, wherein the second side diverges from the first side as it extends towards the base; and wherein said cutting portion further comprising a side surface having three or more facets extending from said base to said generally planar surface.

22. The cutter element of claim 21 wherein said side surface includes at least three facets.

23. The cutter element of claim 22 wherein at least two of said facets differ in width.

24. The cutter element of claim 21 wherein said generally planar surface extends at an angle relative to said first direction of between about 40° and 80°.

25. The cutter element of claim 24 wherein said faceted side surface is tapered in all profile views.

26. The cutter element of claim 24 wherein said planar surface is generally triangular.

27. The cutter element of claim 26 wherein said cutter element comprises a generally cylindrical base portion having diameter D, and comprises a cutting portion extending to an extension height E, and wherein the ratio of E to D is less than or equal to 0.75.

28. The cutter element of claim 21 wherein said faceted side surface and said generally planar surface intersect in an edge forming a polygonal shape that includes at least four sides.

29. The cutter element of claim 28 wherein said polygonal shape is trapezoidal.

30. The cutter element of claim 21 wherein said faceted side surface includes at least two facets that, when viewed from said first direction, have a shape selected from the group consisting of concave and convex.

31. The cutter element of claim 21 wherein said faceted side surface intersects said generally planar surface in a radiused edge that forms the perimeter of said polygonal shape, and wherein said edge includes a second corner that is sharper than at least the first corner.

32. The cutter element of claim 21 wherein each corner of the polygonal shape has a radius of curvature, and wherein the radius of the first corner adjacent the peak is greater than the radius of any other corner of the polygonal shape.

33. A cutter element for a drill bit comprising:

a base portion;

a cutting portion extending from said base portion and comprising a peak and a cutting surface having a slanted and generally planar top surface;

said cutting surface further comprising a side surface extending between said base and said top surface, wherein said side surface includes three or more facets and intersects said top surface in an edge forming a triangular-shaped perimeter of said top surface having a first corner adjacent the peak, a second corner distal the peak, and a third corner distal the peak; and wherein each of said corners of said triangular shape are rounded corners, and wherein at least one of said corners differs in radius from a second of said corners.

34. The cutter element of claim 33 wherein said cutter element comprises a generally cylindrical base portion having diameter D, and comprises a cutting portion extending to an extension height E, and wherein the ratio of E to D is less than or equal to 0.75.

35. The cutter element of claim 34 wherein said side surface of said cutter element is tapered in all profile views.

36. The cutter element of claim 35 wherein at least a first of said facets differs in width from a second of said facets.

37. The cutter element of claim 33 wherein at least one of said facets is selected from the shapes consisting of convex and concave.

38. The cutter element of claim 33 wherein said edge of said triangular shape includes one or more curved sections.

39. The cutter element of claim 33 wherein said generally planar top surface is generally triangular with rounded corners.

40. The cutter element of claim 33 wherein the radius of the first corner adjacent the peak is greater than the radius of any other corner of the triangular-shaped perimeter.

* * * * *